US005653331A

United States Patent [19]

Graf

[11] Patent Number: 5,653,331

[45] Date of Patent: Aug. 5, 1997

[54] PAPER ROLL GUIDE

[75] Inventor: Edwin X. Graf, Menasha, Wis.

[73] Assignee: Voith Sulzer Papiermaschinen GmbH, Heidenheim, Germany

[21] Appl. No.: 611,240

[22] Filed: Mar. 5, 1996

[51] Int. Cl.[6] ..... B65G 39/16

[52] U.S. Cl. ..... 198/807; 474/104

[58] Field of Search ..... 198/806, 807, 198/502.1, 502.4; 474/104, 123

[56] References Cited

U.S. PATENT DOCUMENTS

| | | | |
|---|---|---|---|
| 3,159,268 | 12/1964 | Dyke | 198/807 |
| 5,117,969 | 6/1992 | Roth | 198/807 |
| 5,248,027 | 9/1993 | Kluger et al. | 198/807 X |

FOREIGN PATENT DOCUMENTS

| | | | |
|---|---|---|---|
| 204132 | 6/1956 | Australia | 198/807 |
| 403124608 | 5/1991 | Japan | 198/807 |
| 406127649 | 5/1994 | Japan | 198/807 |
| 834014 | 5/1960 | United Kingdom | 198/807 |
| 920775 | 3/1963 | United Kingdom | 198/807 |
| 2206553 | 1/1989 | United Kingdom | 198/807 |

*Primary Examiner*—D. Glenn Dayoan
*Attorney, Agent, or Firm*—Taylor & Associates, P.C.

[57] ABSTRACT

The invention is directed to a guide connectable to a paper roll in a paper machine for moving an end of the roll in a direction transverse to a longitudinal axis of the roll. The guide includes a roll mounting frame connectable to the roll, a support frame, and at least one elongate member interconnecting the support frame with the roll mounting frame. The at least one elongate member is elastically deformable in the transverse direction and thereby allows movement of the roll mounting frame relative to the support frame in the transverse direction. A positioning device is engaged with the roll mounting frame for moving the roll mounting frame in the transverse direction and maintaining the roll mounting frame in one of a plurality of positions relative to the support frame.

24 Claims, 1 Drawing Sheet

PAPER ROLL GUIDE

BACKGROUND OF THE INVENTION

1. Field of the Invention

The present invention relates to paper machines, and, more particularly, to a guide for moving a paper roll in a paper machine and thereby steering a moving web.

2. Description of the Related Art

Paper machines typically include a belt which is used to carry a fiber material disposed across the width thereof, such as a fiber web in the form of a paper web. The belt is carried by a plurality of rolls, and may be in the form of, e.g., a polyester forming fabric, felt, conveyor belt, or dryer fabric. A plurality of belts may be provided which successively carry the fiber web from one end of the paper machine to the other end. Such belts can generally be viewed as conveying, dewatering and drying belts.

To properly position the belt on the paper machine during operation, it is necessary that the belt be "steered" such that the belt moves a predetermined amount from side to side on the machine during operation. Typically, a mechanical paddle disposed on each side of the belt may be engaged by the belt upon occurrence of sideways movement of the belt past a predetermined threshold. Actuation of the paddle in turn causes a roll guide to move an end of a selected paper roll in a predetermined transverse direction relative to the longitudinal axis of the selected roll. Such transverse movement of the roll causes the belt to move back toward the opposite side of the machine, thus maintaining the belt in proper running alignment on the paper machine.

Conventional roll guides used for moving a roll in a transverse direction relative to the longitudinal axis of the roll typically include a roll mounting frame to which an end of the roll is connected. The roll mounting frame is connected to a further support frame using a pair of rigid arms which are pivotally attached at opposing ends thereof to the roll mounting frame and support frame using a reduced friction bearing assembly, such as a spherical roller bearing. The rigid arms oscillate over a very limited range of movement as the roll mounting frame is moved in the transverse direction by a positioning device, such as a screw or the like.

A problem with conventional paper roll guides is that the anti-friction bearing pivots undergo only limited oscillatory movement. Such oscillatory movement does not allow proper elastro-hydrodynamic lubrication of the bearings, such as by formation of an oil film between the inner and outer races, and allows metal to metal contact to occur in the bearing. When such metal to metal contact occurs, "brinelling" results. Brinelling and subsequent spalling result in permanent deformation of the bearing and shortened life of the paper roll guide.

What is needed in the art is a paper roll guide which is simpler and less expensive than conventional paper roll guides, and which avoids the problem of proper lubrication of bearings present in conventional paper roll guides.

SUMMARY OF THE INVENTION

The present invention provides a guide for moving an end of the paper roll in a transverse direction to a longitudinal axis of the paper roll, wherein an elongate member connected to a roll mounting frame is elastically deflectable in the transverse direction and allows movement of the roll mounting frame in the transverse direction.

The invention comprises, in one form thereof, a guide connectable to a paper roll in a paper machine for moving an end of the roll in a direction transverse to a longitudinal axis of the roll. The guide includes a roll mounting frame connectable to the roll, a support frame, and at least one elongate member interconnecting the support frame with the roll mounting frame. The at least one elongate member is elastically deformable in the transverse direction and thereby allows movement of the roll mounting frame relative to the support frame in the transverse direction. A positioning device is engaged with the roll mounting frame for moving the roll mounting frame in the transverse direction and maintaining the roll mounting frame in one of a plurality of positions relative to the support frame.

An advantage of the present invention is that a reliable, yet relatively inexpensive paper roll guide is provided.

Another advantage is that the roll guide of the present invention does not utilize ball or roller bearings allowing movement of the roll mounting frame, thereby eliminating the problem of brinelling and spalling that occurs when such bearings undergo repeated oscillatory motion without proper lubrication.

Yet another advantage is that the paper roll guide of the present invention has a simplified structure as compared to conventional roll guides.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
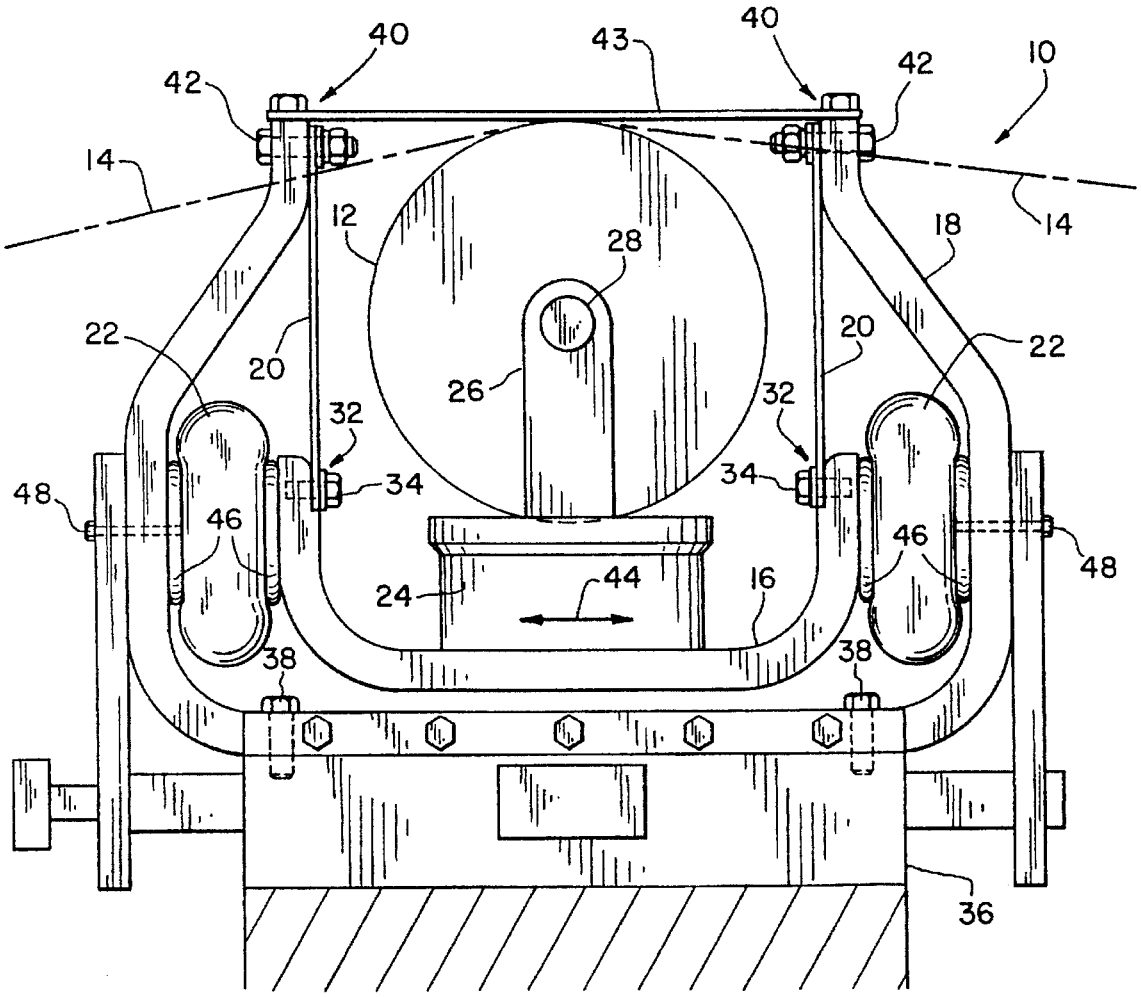
FIG. 1 is a plan view of an embodiment of a paper roll guide of the present invention.
Figure 2:
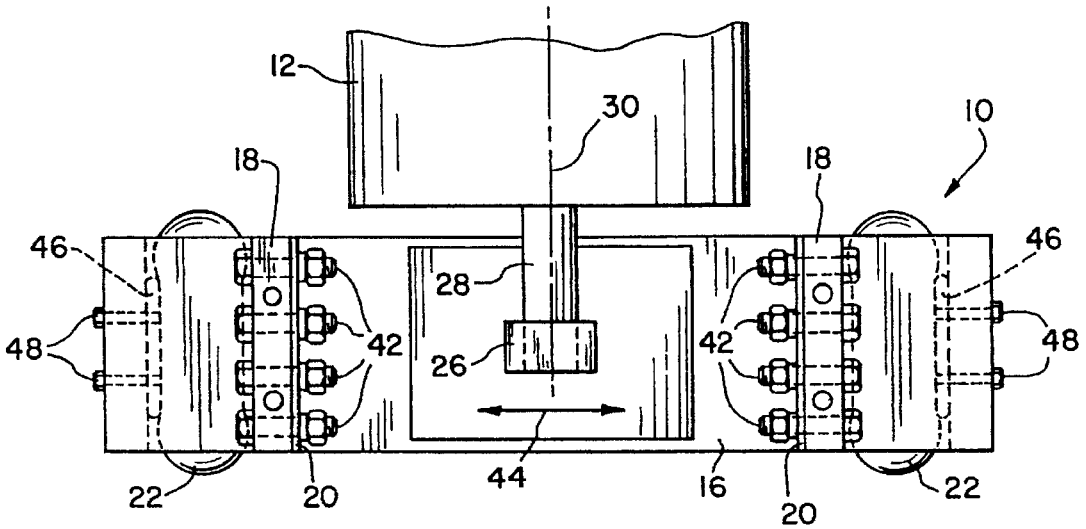
FIG. 2 is a top view of the paper roll guide shown in FIG. 1, with the top plate removed.

Referring now to the drawings, and more particularly to FIGS. 1 and 2, there is shown an embodiment of a paper roll guide 10 of the present invention. Guide 10 is part of a paper machine, such as a paper-making machine, which includes a roll 12 for carrying a belt 14. Belt 14 is intended to be defined broadly herein, and may be, e.g., an endless belt for conveying, dewatering and/or drying a fiber web carried thereby.

Guide 10 generally includes a roll mounting frame 16, a support frame 18, two elongate members 20, and positioning device 22. Roll mounting frame 16 is connected to roll 12 using a mounting 24 having an arm 26. Mounting 24 and arm 26 include suitable bearings and the like for rotatably carrying and supporting roll 12. In particular, a shaft 28 attached to an end of roll 12 is rotatably carried by arm 26. A longitudinal axis 30 roll 12 is substantially coaxial with shaft 28.

Roll mounting frame 16 is generally U-shaped as shown in FIG. 1. Roll mounting frame 16 includes at least two connection points, i.e., one connection point at each end thereof for connection to a respective elongate member 20.

In the particular embodiment shown, roll mounting frame 16 includes four (4) connection points 32 at each end thereof. Connection points 32 are in the form of threaded openings in which studs 34 are threadingly engaged. Through the use of the metal forming process used to form roll mounting frame 16, the manufacturing effort and costs involved in making guide 10 are tremendously reduced.

Support frame 18 is generally U-shaped, as shown in FIG. 1, and is disposed at least partially around roll mounting frame 16. Support frame 18 is attached to an essentially immovable base 36 using fasteners 38. Support frame 18 includes at least two connection points 40, i.e., at least one connection point 40 at each opposing end of support frame 18, for connection to a respective elongate member 20. In the embodiment shown, support frame 18 includes four (4) connection points 40 at each end thereof which are in the form of openings for receiving fasteners such as bolts 42 therein. Connection points 40 of support frame 18 are disposed above connection points 32 of roll mounting frame 16, as shown in FIG. 1. A top plate 43 (shown installed in FIG. 1 and removed in FIG. 2) inhibits relative movement between the opposing ends of support frame 18.

Elongate members 20 interconnect roll mounting frame 16 with support frame 18. Elongate members 20 are elastically deformable in a transverse direction to longitudinal axis 30, as indicated by directional arrow 44. Elongate members 20 thus allow movement of roll mounting frame 16 relative to support frame 18 in the transverse direction 44.

Elongate members 20 can be constructed with a variety of configurations and from a number of different materials to allow the movement of roll mounting frame 16 in transverse direction 44. In the embodiment shown in the drawings, elongate members 20 are each in the form of a plate which is constructed from fiberglass which allows repeated movement of roll mounting frame 16 in transverse direction 44. Elongate members 20 may also be in the form of cable, conveyor belting or the like, which would allow transverse movement of roll mounting frame 16. Moreover, elongate members 20 may be constructed from other materials having a long fatigue life, such as carbon fiber, beryllium copper, fiber-reinforced plastic, carbon fiber-reinforced plastic, multiple layer stainless steel, or other suitable material.

Elongate members 20 include a plurality of openings (not shown) at opposing ends thereof for receiving studs 34 and bolts 42 therein. Elongate members 20 are thus connected at opposing ends thereof to roll mounting frame 16 and support frame 18.

Positioning device 22, in the embodiment shown, is in the form of two inflatable elastic members disposed between roll mounting frame 16 and support frame 18. Inflatable elastic members 22 may be formed from a suitable elastic material, such as neoprene or silicone rubber, and may be fiber reinforced. Inflatable elastic members 22 are engaged with roll mounting frame 16 for moving roll mounting frame 16 in the transverse direction 44 and maintaining roll mounting frame 16 in one of a plurality of positions relative to support frame 18.

More particularly, inflatable elastic members 22 include metal plates 46 which are mounted thereto, such as by vulcanizing or epoxying. The plate of each inflatable elastic member 22 which is disposed against support frame 18 includes threaded openings (not numbered) for receiving bolts 48 therein. Each inflatable elastic member 22 is thus attached to support frame 18 using bolts 48. On the other hand, inflatable elastic members 22 are operated so as to always be in contact with roll mounting frame 16. Accordingly, it is not necessary for inflatable elastic members 22 to be attached to roll mounting frame 16 (although such attachment is optional). Inflatable elastic members 22 are therefore only engaged with (and not attached to) roll mounting frame 16.

Inflatable elastic members 22 are connected to a source of air (not shown) which maintains a selected pressure within each inflatable elastic member 22. The air pressure within each inflatable elastic member 22 is dependent upon a signal which is received from a mechanical paddle or the like indicating a position of the running belt on the roll, as described above in the section entitled "Background Of The Invention." Typically, one inflatable elastic member 22 is inflated while the other inflatable elastic member 22 is deflated, thereby effecting movement of roll 12 in a desired transverse direction 44 relative to longitudinal axis 30.

In the embodiment shown, positioning device 22 is in the form of two inflatable elastic members 22, as described above. However, it will also be appreciated that other positioning devices may be used for moving roll mounting frame 16 in transverse direction 44. For example, positioning device 22 can be in the form of a hydraulic, pneumatic, mechanical, electrical and/or electro-mechanical device which effects movement of roll mounting frame 16 in transverse direction 44.

Moreover, in the embodiment shown in the drawings, support frame 18 is in the form of a U-shaped frame disposed at least partially around roll mounting frame 16, and positioning device 22 is attached to support frame 18. It will also be appreciated, however, that positioning device 22 need not necessarily be attached to support frame 18. Rather, positioning device 22 can be engaged with another substantially immovable object, such as a freestanding frame or the like. Support frame 18 could thus be disposed, e.g., above roll mounting frame 16, at one side and above roll mounting frame 16, or at one side and below roll mounting frame 16.

From the foregoing description, it will be appreciated that through the simplification of guide 10 over previous designs, the present invention has developed the art to the point of nearly eliminating maintenance on guide 10.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper machine, a guide connected to a roll for moving an end of the roll in a transverse direction to a longitudinal axis of the roll, the improvement wherein said guide comprises:

a roll mounting frame connected to the roll;

a support frame;

at least one elongate member interconnecting said support frame with said roll mounting frame, said at least one elongate member being elastically deformable in the transverse direction and thereby allowing movement of the roll mounting frame relative to the support frame in the transverse direction; and a positioning device engaged with said roll mounting frame for moving said roll mounting frame in the transverse direction and maintaining said roll mounting frame in one of a plurality of positions relative to said support frame.

2. The paper machine of claim 1, wherein said roll mounting frame includes at least two connection points and said support frame includes at least two connection points, said support frame connection points disposed above said roll mounting frame connection points, and wherein said at least one elongate member comprises two elongate members, each said elongate member being connected to at least one of said support frame connection points at one end thereof and to at least one of said roll mounting frame connection points at an other end thereof.

3. The paper machine of claim 2, wherein each of said support frame connection points comprises an opening in said support frame, and wherein each of said roll mounting frame connection points comprises an opening in said roll mounting frame, and further comprising a plurality of fasteners disposed in each respective said opening, each said elongate member being connected to a respective said support frame and said roll mounting frame with said fasteners.

4. The paper machine of claim 3, wherein each of said fasteners comprise one of a bolt and a stud.

5. The paper machine of claim 1, wherein said support frame is disposed at least partially around said roll mounting frame.

6. The paper machine of claim 5, wherein each of said roll mounting frame and said support frame are generally U-shaped.

7. The paper machine of claim 1, wherein said at least one elongate member comprises two plates.

8. The paper machine of claim 1, wherein said at least one elongate member is comprised of a material selected from the group consisting of fiberglass, carbon fiber reinforced plastic, fiberglass reinforced plastic, beryllium copper and stainless steel.

9. The paper machine of claim 1, wherein said positioning device is attached to said support frame.

10. The paper machine of claim 9, wherein said positioning device comprises an inflatable elastic member.

11. The paper machine of claim 10, wherein said inflatable elastic member comprises a material selected from the group consisting essentially of neoprene and silicone rubber.

12. The paper machine of claim 9, wherein said positioning device comprises two inflatable elastic members, each said inflatable elastic member connected to a side of said support frame.

13. A guide connectable to a roll in a paper machine for moving an end of the roll in a direction transverse to a longitudinal axis of the roll, said guide comprising:

a roll mounting frame connectable to the roll;

a support frame;

at least one elongate member interconnecting said support frame with said roll mounting frame, said at least one elongate member being elastically deformable in the transverse direction and thereby allowing movement of the roll mounting frame relative to the support frame in the transverse direction; and a positioning device engaged with said roll mounting frame for moving said roll mounting frame in the transverse direction and maintaining said roll mounting frame in one of a plurality of positions relative to said support frame.

14. The guide of claim 13, wherein said roll mounting frame includes two connection points and said support frame includes two connection points, said support frame connection points disposed above said roll mounting frame connection points, and wherein said at least one elongate member comprises two elongate members, each said elongate member being connected to one of said support frame connection points at one end thereof and one of said roll mounting frame connection points at an other end thereof.

15. The guide of claim 14, wherein each of said support frame connection points comprises an opening in said support frame, and wherein each of said roll mounting frame connection points comprises an opening in said roll mounting frame, and further comprising a plurality of fasteners disposed in each respective said opening, each said elongate member being connected to a respective said support frame and said roll mounting frame with said fasteners.

16. The guide of claim 15, wherein each of said fasteners comprise one of a bolt and a stud.

17. The guide of claim 13, wherein said support frame is disposed at least partially around said roll mounting frame.

18. The guide of claim 17, wherein each of said roll mounting frame and said support frame are generally U-shaped.

19. The guide of claim 13, wherein said at least one elongate member comprises two plates.

20. The guide of claim 13, wherein said at least one elongate member is comprised of a material selected from the group consisting of fiberglass, carbon fiber reinforced plastic, fiberglass reinforced plastic, beryllium copper and stainless steel.

21. The guide of claim 13, wherein said positioning device is attached to said support frame.

22. The guide of claim 21, wherein said positioning device comprises an inflatable elastic member.

23. The guide of claim 22, wherein said inflatable elastic member comprises a material selected from the group consisting essentially of neoprene and silicone rubber.

24. The guide of claim 21, wherein said positioning device comprises two inflatable elastic members, each said inflatable elastic member connected to a side of said support frame.

* * * * *